US008393824B2

(12) United States Patent
Schroeder et al.

(10) Patent No.: US 8,393,824 B2
(45) Date of Patent: Mar. 12, 2013

(54) SCREED DIE ADJUSTABLE LINE THICKNESS

(75) Inventors: James C. Schroeder, Ramsey, MN (US); Steven H. Fredrickson, Minneapolis, MN (US); Roland M. Bedard, Lindstrom, MN (US); Thomas L. Triplett, Rockford, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 13/386,916

(22) PCT Filed: Jul. 27, 2010

(86) PCT No.: PCT/US2010/043298

§ 371 (c)(1),
(2), (4) Date: Jan. 25, 2012

(87) PCT Pub. No.: WO2011/017067

PCT Pub. Date: Feb. 10, 2011

(65) Prior Publication Data

US 2012/0121331 A1 May 17, 2012

Related U.S. Application Data

(60) Provisional application No. 61/228,691, filed on Jul. 27, 2009.

(51) Int. Cl.
*E01C 23/16* (2006.01)

(52) U.S. Cl. ..... 404/94; 404/93; 404/108

(58) Field of Classification Search ..... 404/93, 404/94, 107, 108

See application file for complete search history.

(56) References Cited

U.S. PATENT DOCUMENTS

| | | | | |
|---|---|---|---|---|
| 2,241,863 | A | 9/1941 | Lett | |
| 2,612,374 | A | 9/1952 | Wilson | |
| 3,964,835 | A | 6/1976 | Eigenmann | |
| 4,802,788 | A | 2/1989 | Smith | |
| 5,039,557 | A | 8/1991 | White | |
| 6,227,454 | B1 * | 5/2001 | Wolf et al. | 239/1 |
| 6,524,412 | B2 * | 2/2003 | Smith | 156/71 |
| 7,070,358 | B2 | 7/2006 | Hicks | |
| 2009/0202298 | A1 * | 8/2009 | Bjorklund | 404/77 |
| 2011/0020064 | A1 * | 1/2011 | Schroeder et al. | 404/94 |

FOREIGN PATENT DOCUMENTS

| | | | |
|---|---|---|---|
| DE | 4116974 | A1 | 11/1992 |
| GB | 706718 | A | 4/1954 |
| JP | 482012 | | 7/1992 |

OTHER PUBLICATIONS

Apollo Handliner Series brochure from M-B Companies, Inc. dated Dec. 2008.

Trantex Model CH220M Thermoplastic Applicator, Misc. Information and dates.

* cited by examiner

*Primary Examiner* — Gary S Hartmann
(74) *Attorney, Agent, or Firm* — Douglas B. Farrow

(57) ABSTRACT

An adjustable spacer plate 12 mounts over the US standard screed box 10 thermoplastic opening 14 of 0.125" and creates a 0.090" opening.[This eliminates the need for the user to buy another costly screed box.] For screeding over stencils, the spacer 12 can be flipped to create a zero clearance opening. This allows the thermoplastic to come out only when an opening in the stencil pattern is present. Also, as the die 14 wears down, the spacer can be removed which lets the standard size opening be used as a substitute for the 0.090" opening.

2 Claims, 7 Drawing Sheets

SCREED DIE ADJUSTABLE LINE THICKNESS

TECHNICAL FIELD

This application claims the benefit of U.S. Application Ser. No. 61/228,691, filed Jul. 27, 2009, the contents of which are hereby incorporated by reference.

BACKGROUND ART

Devices for applying thermal markings and striping to roadways and the like are well known.

DISCLOSURE OF THE INVENTION

This invention combines the line depth function of two screed boxes into one using an adjustable spacer plate.

An adjustable spacer plate mounts over the US standard thermoplastic opening of 0.125" and creates a 0.090" opening. For Europe, the standard opening is 0.100" and the spacer plate creates a 0.060" opening. This eliminates the need for the user to buy another costly screed box.

Before this design a separate box was needed for screeding over stencils, but now the spacer can be flipped to create a zero clearance opening. This allows the thermoplastic to come out only when an opening in the stencil pattern is present.

The spacer is attached to the box using a set of acorn nuts. This hardware feature is beneficial in deterring thermoplastic from getting to the threads and allows for easier spacer plate attachment and removal.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
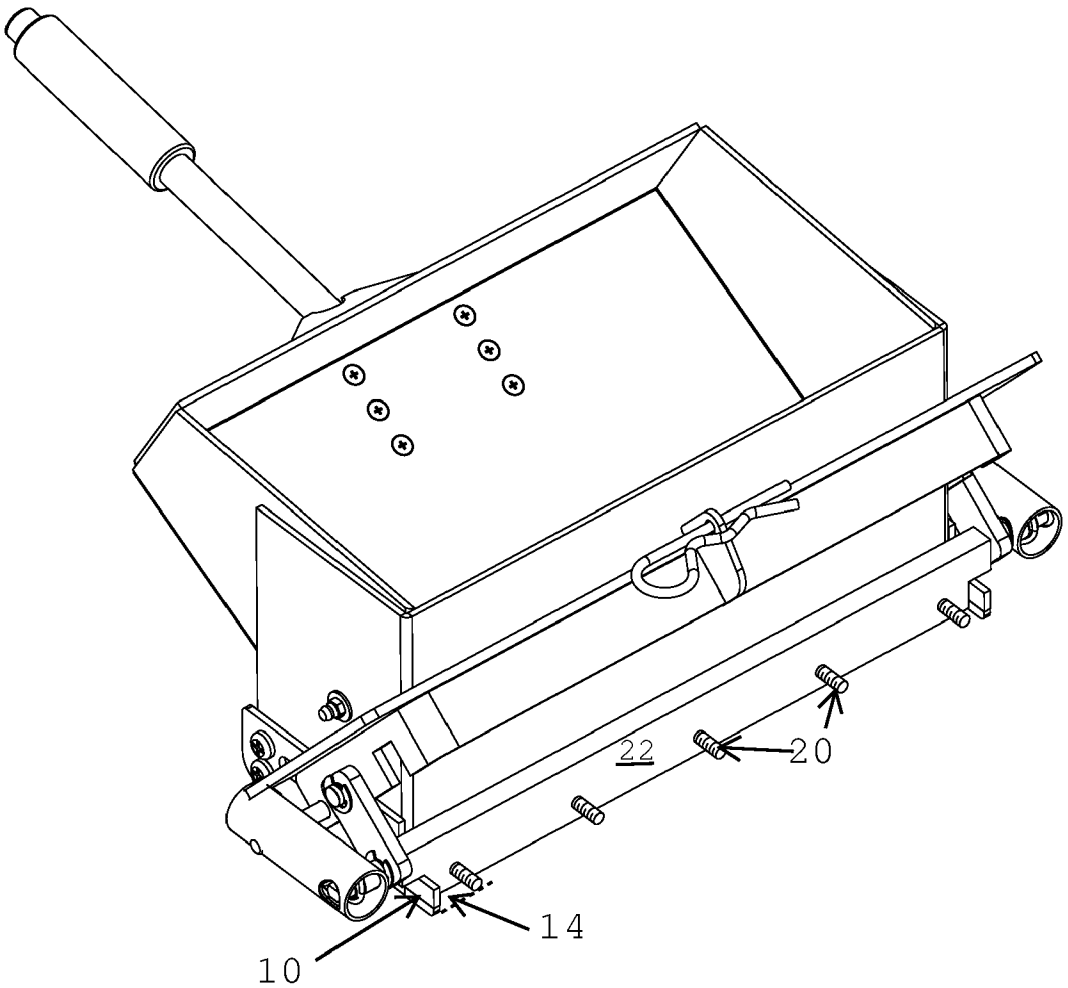
FIG. 1 shows a screed box with a standard opening.
Figure 2:
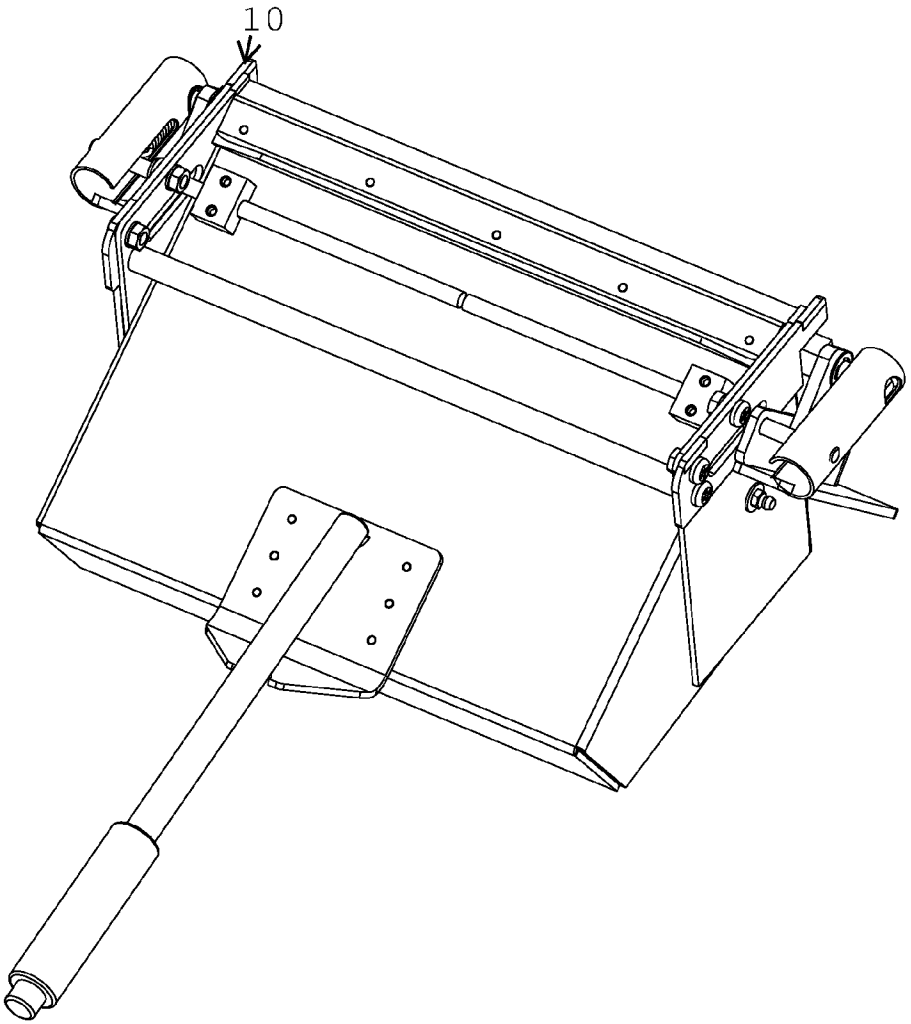
FIG. 2 shows the bottom of a screed box with a standard opening.

An adjustable spacer plate 12 mounts over the US standard screed box 10 thermoplastic die wall 22 opening 14 of 0.125" and creates a 0.090" opening. For Europe, the standard opening is 0.100" and the spacer plate creates a 0.060" opening. This eliminates the need for the user to buy another costly screed box.

Before this design a separate box was needed for screeding over stencils, but now the spacer 12 can be flipped to create a zero clearance opening. This allows the thermoplastic to come out only when an opening in the stencil pattern is present. Also, as the die 14 wears down, the spacer can be removed which lets the standard size opening be used as a substitute for the 0.090" opening.

Figure 3:
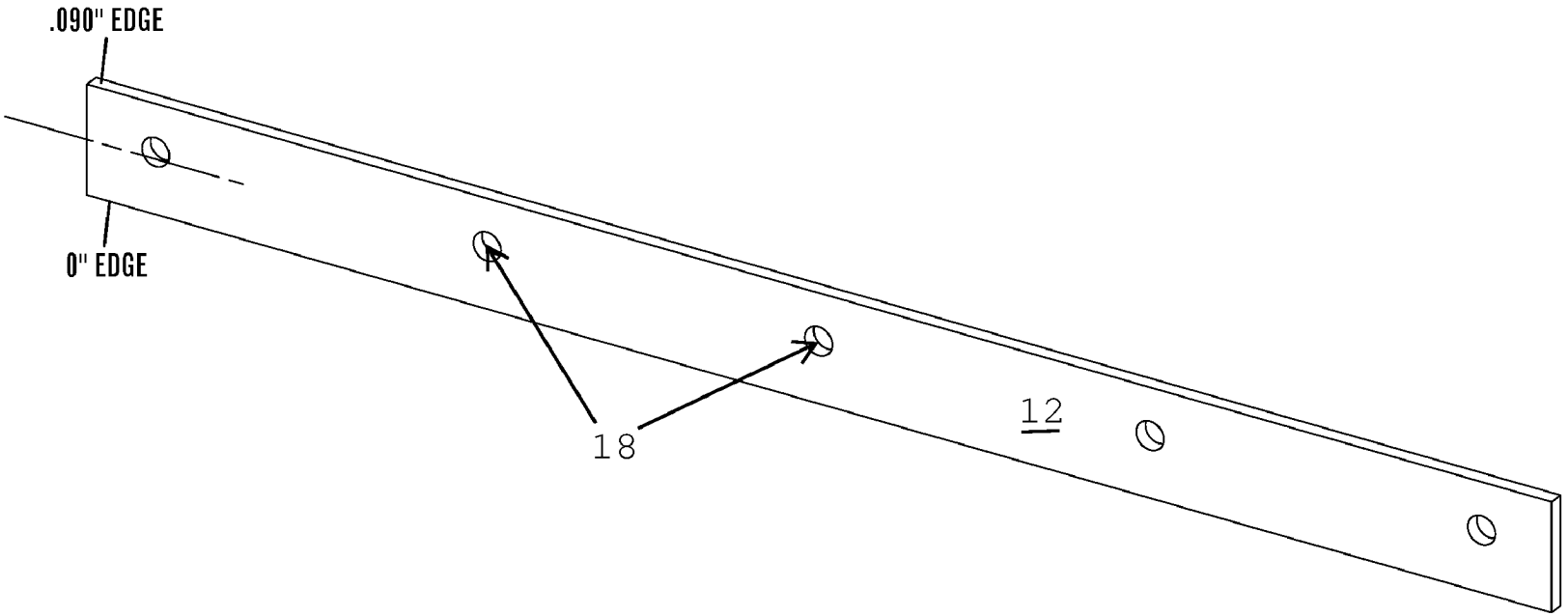
FIG. 3 shows a spacer which will provide alternate desired openings.
Figure 4:
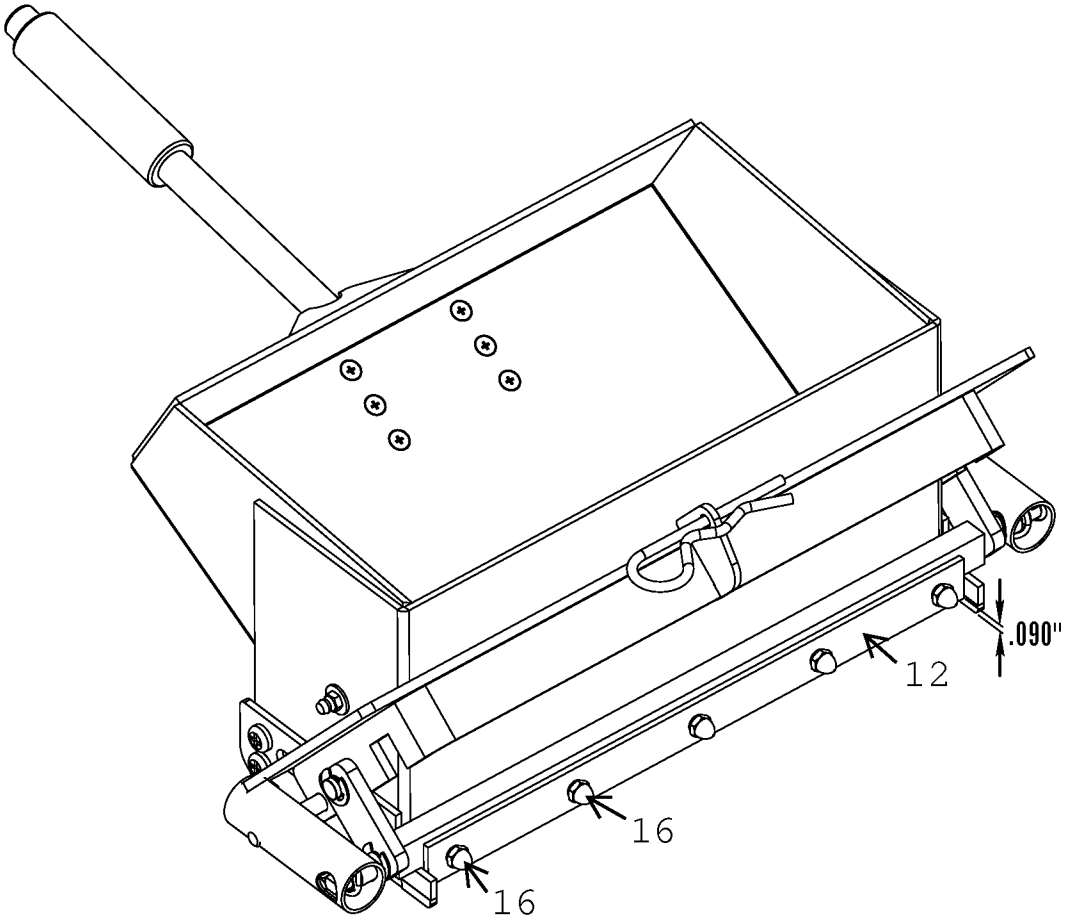
FIG. 4 shows a screed box using the spacer with a fixed opening.
Figure 5:
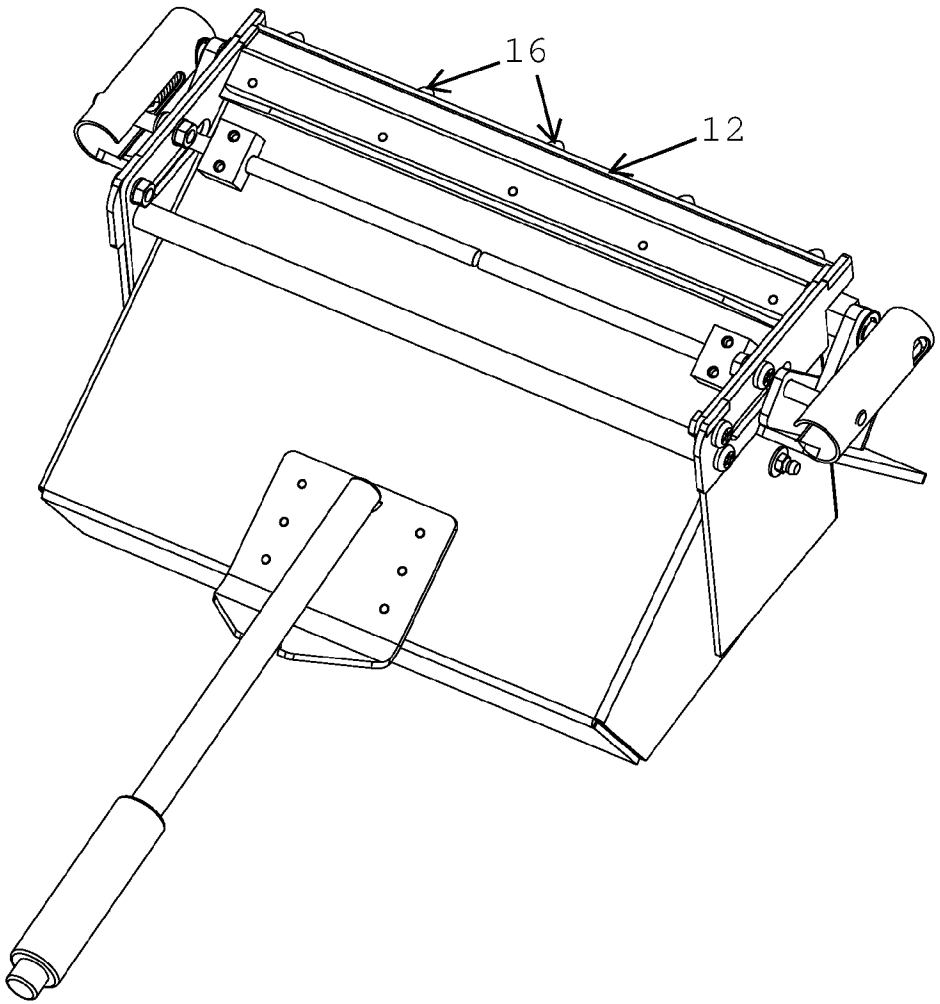
FIG. 5 shows the bottom of a screed box using the spacer with a fixed opening.
Figure 6:
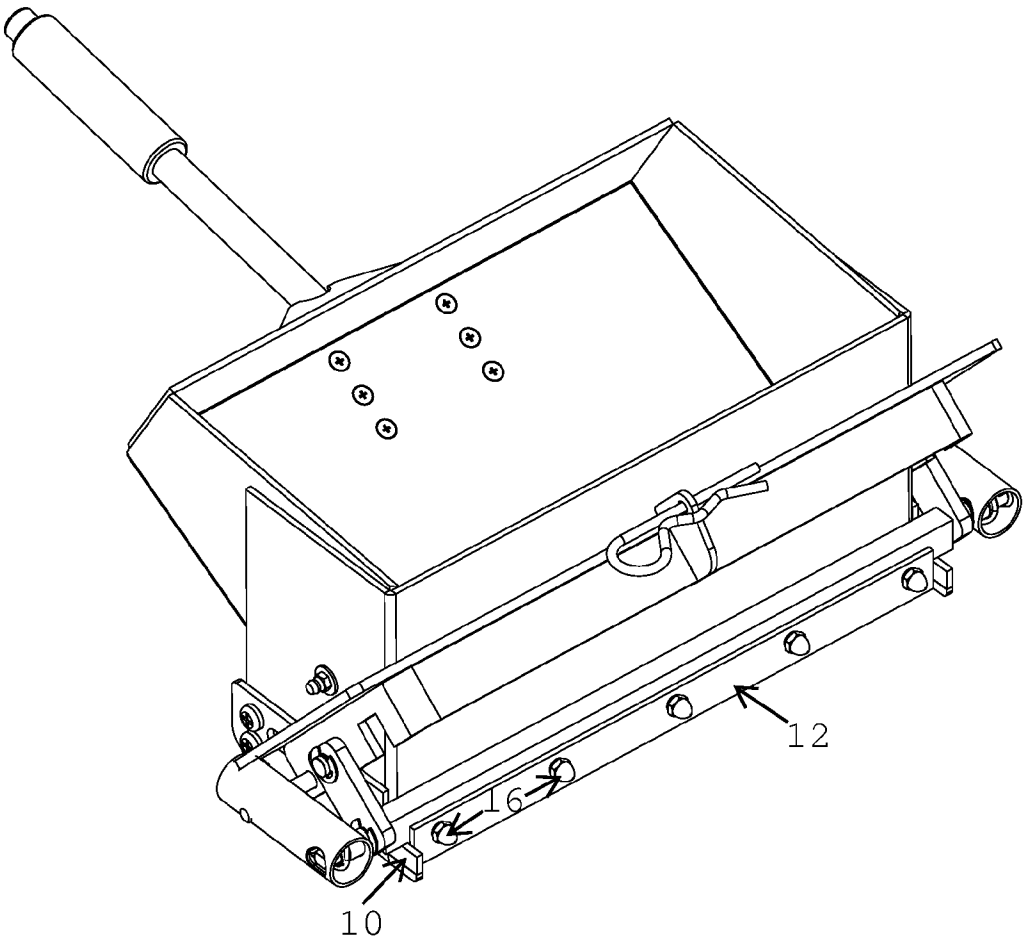
FIG. 6 shows a screed box using the spacer with a zero opening.
Figure 7:
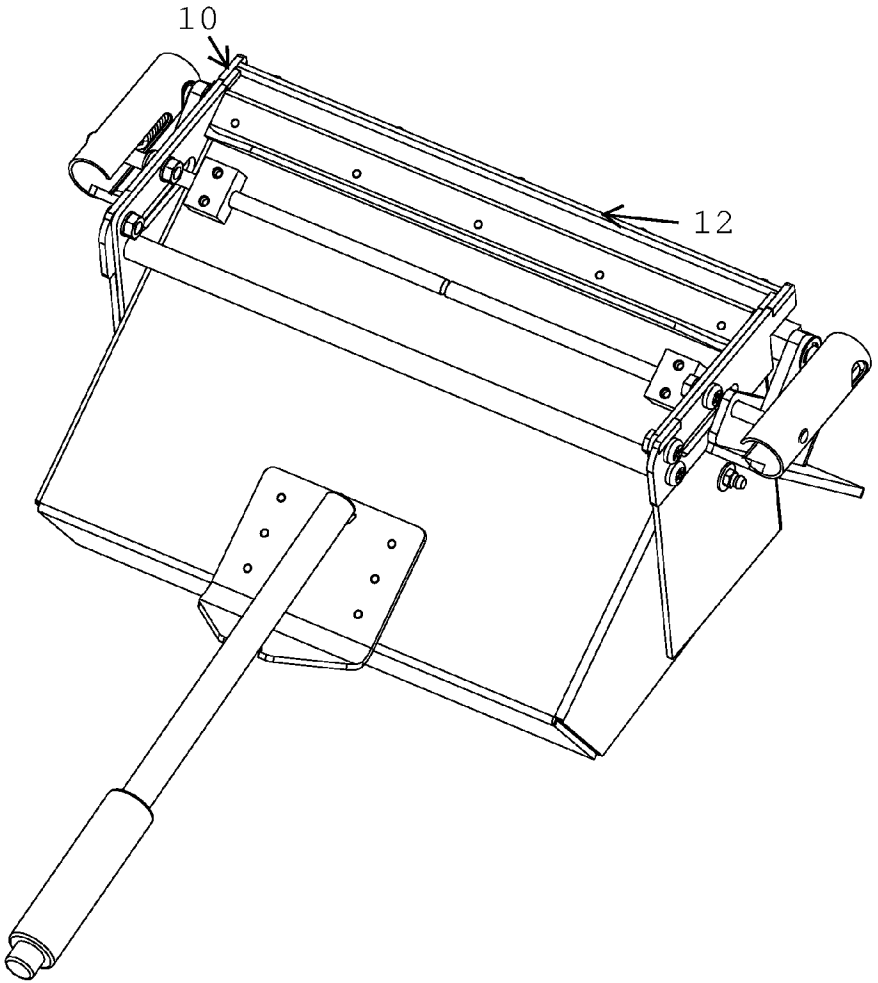
FIG. 7 shows the bottom of a screed box using the spacer with a zero opening.

The spacer is attached to the box 10 using a set of acorn nuts 16. This hardware feature is beneficial in deterring thermoplastic from getting to the threads on studs 20 (alternatively, bolts or other known fasteners can be used instead of studs and acorn nuts) and allows for easier spacer plate 12 attachment and removal. As can be seen in FIG. 3, the centerline of the holes 18 is offset somewhat from the centerline of the spacer 12 to allow alternate openings.

It is contemplated that various changes and modifications may be made to the adjustable screed without departing from the spirit and scope of the invention as defined by the following claims.

The invention claimed is:

1. An adjustable screed die line thickness mechanism, said screed die mechanism comprising:

a screed box having a die wall, said die wall providing an opening when said box is on the ground;

a spacer plate having a thickness, a longitudinal centerline and a plurality of apertures extending through said plate thickness and arranged linearly along a line parallel to and offset from said centerline; and means for removably fastening said spacer plate to said die wall through said apertures in alternate positions to provide alternate opening sizes wherein said apertures are located so that said spacer plate can be flipped to provide said alternate opening sizes.

2. The adjustable screed die line thickness mechanism of claim 1 wherein said apertures are located so that one of said opening sizes is zero.

* * * * *